US010378746B2

(12) United States Patent
Skergeth et al.

(10) Patent No.: US 10,378,746 B2
(45) Date of Patent: Aug. 13, 2019

(54) LIGHT DEVICE WITH AN LED LIGHTING MODULE

(71) Applicant: ZUMTOBEL LIGHTING GMBH, Dornbirn (AT)

(72) Inventors: Sascha Skergeth, Lustenau (AT); Matthias Menke, Hard (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 549 days.

(21) Appl. No.: 14/773,503

(22) PCT Filed: Mar. 3, 2014

(86) PCT No.: PCT/EP2014/054050

§ 371 (c)(1),
(2) Date: Sep. 8, 2015

(87) PCT Pub. No.: WO2014/135486

PCT Pub. Date: Sep. 12, 2014

(65) Prior Publication Data

US 2016/0025318 A1 Jan. 28, 2016

(30) Foreign Application Priority Data

Mar. 7, 2013 (DE) ..... 10 2013 203 916

(51) Int. Cl.
*F21V 21/00* (2006.01)
*F21V 23/06* (2006.01)
(Continued)

(52) U.S. Cl.
CPC ..... *F21V 23/06* (2013.01); *F21K 9/20* (2016.08); *F21S 8/046* (2013.01); *F21S 8/06* (2013.01);
(Continued)

(58) Field of Classification Search
CPC ..... F21Y 2103/10; F21V 23/06; F21V 17/10; F21V 19/001; F21V 19/0015; F21S 4/28;
(Continued)

(56) References Cited

U.S. PATENT DOCUMENTS 8,287,144 B2 * 10/2012 Pedersen ..... F21S 10/02 362/217.01
9,644,828 B1 * 5/2017 May ..... F21V 7/00
(Continued)

FOREIGN PATENT DOCUMENTS

CN 201078687 6/2008
DE 29823255 5/2000
(Continued)

OTHER PUBLICATIONS

International Search Report for PCT/EP2014/054050, English translation attached to original, Both completed by the European Patent Office dated May 13, 2014, 7 Pages.
(Continued)

*Primary Examiner* — Andrew J Coughlin
(74) *Attorney, Agent, or Firm* — Brooks Kushman P.C.

(57) ABSTRACT

A lighting device having a support element with an elongated receiving region which has a U-shaped cross-section and having a first limb of the U, a second limb of the U, and a connecting limb that connects the two limbs of the U. The lighting device further has an LED lighting module with at least one LED for generating light in order to emit a light of the lighting device, the LED lighting module being arranged on the support element in a retained manner. The lighting device further has a contacting element for supplying power to the LED lighting module. The connecting limb has a through-opening, the contacting element and LED lighting module being arranged so as to be connected in an electri-
(Continued)

Figure 2:
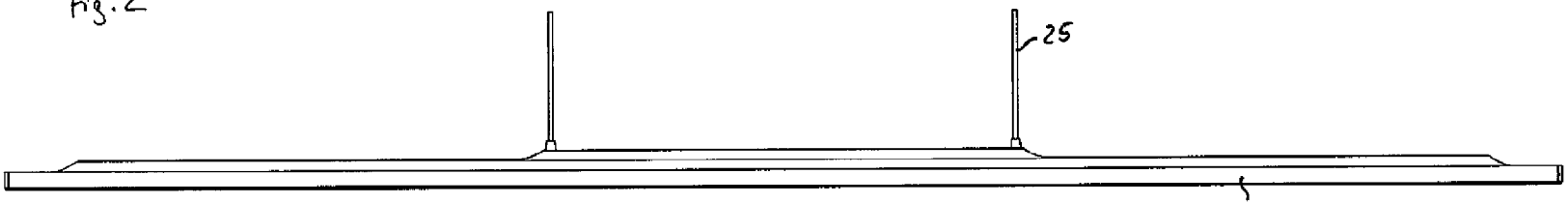

cally conductive and reversibly releasable manner such that the electric connection passes through the through-opening.

13 Claims, 7 Drawing Sheets

(51) Int. Cl.

| | |
|---|---|
| ***F21S 8/06*** | (2006.01) |
| ***F21V 17/16*** | (2006.01) |
| ***F21V 19/00*** | (2006.01) |
| ***F21V 19/04*** | (2006.01) |
| ***F21S 8/04*** | (2006.01) |
| ***F21K 9/20*** | (2016.01) |
| *F21Y 105/10* | (2016.01) |
| *F21Y 103/10* | (2016.01) |
| *F21Y 115/10* | (2016.01) |

(52) U.S. Cl.
CPC ..... *F21V 17/164* (2013.01); *F21V 19/003* (2013.01); *F21V 19/004* (2013.01); *F21V 19/04* (2013.01); *F21Y 2103/10* (2016.08); *F21Y 2105/10* (2016.08); *F21Y 2115/10* (2016.08)

(58) Field of Classification Search
CPC .. F21S 48/115; F21S 8/046; F21S 8/06; F21S 8/061; F21S 8/063
See application file for complete search history.

(56) References Cited

U.S. PATENT DOCUMENTS

| | | | | |
|---|---|---|---|---|
| 10,113,718 | B2 * | 10/2018 | Gorman | F21V 15/013 |
| 2002/0114155 | A1 * | 8/2002 | Katogi | F21S 2/00 362/219 |
| 2009/0073693 | A1 * | 3/2009 | Nall | G09F 13/04 362/249.02 |
| 2012/0002409 | A1 * | 1/2012 | Donauer | A47H 1/144 362/218 |
| 2012/0014108 | A1 | 1/2012 | Greenfield et al. | |
| 2012/0020109 | A1 | 1/2012 | Kim et al. | |
| 2012/0300437 | A1 | 11/2012 | Lu et al. | |
| 2013/0229802 | A1 | 9/2013 | Fukushima et al. | |
| 2013/0265780 | A1 * | 10/2013 | Choksi | F21V 21/145 362/373 |
| 2013/0335967 | A1 * | 12/2013 | Reingruber | F21V 7/00 362/235 |
| 2014/0362574 | A1 * | 12/2014 | Barrett | F21S 2/00 362/249.03 |

FOREIGN PATENT DOCUMENTS

| | | |
|---|---|---|
| DE | 20307174 | 9/2003 |
| DE | 202009005470 | 6/2009 |
| DE | 102008036474 | 2/2010 |
| EP | 2565516 | 3/2013 |
| WO | 2006127785 | 11/2006 |
| WO | 2011106695 | 9/2011 |
| WO | 2011118991 | 9/2011 |
| WO | 2012073543 | 6/2012 |

OTHER PUBLICATIONS

Chinese Search Report for Chinese Application No. CN 201480011752.6, Completed by the Chinese Patent Office dated Nov. 9, 2017, 2 Pages.

Chinese Office Action for Chinese Application No. CN 201480011752.6 Completed by the Chinese Patent Office dated Nov. 16, 2017, 10 Pages.

* cited by examiner

LIGHT DEVICE WITH AN LED LIGHTING MODULE

CROSS-REFERENCE TO RELATED APPLICATION

This application is the U.S. national phase of PCT Application No. PCT/EP2014/054050 filed on Mar. 3, 2014, which claims priority to DE Patent Application No. 10 2013 203 916.6 filed on Mar. 7, 2013, the disclosures of which are incorporated in their entirety by reference herein.

The invention relates to a lighting device comprising a carrier element and an LED lighting module held on the carrier element.

Such a lighting device is known from DE 10 2008 036 474 A1. This lighting device is configured in order to be inserted into a U-shaped carrier rail which is open at the bottom. Electrical conductors for the electricity supply of the lighting device extend through the carrier rail. When the lighting device is removed, these conductors are in principle directly accessible.

Furthermore, two contacting elements are to be rotated by means of two rotary knobs for the mechanical and electrical connection of the lighting device to the carrier rail.

The object of the invention is to provide a corresponding improved lighting device. In particular, the lighting device is intended to allow particularly straightforward, secure and reliable replacement of the LED lighting module. The lighting device is furthermore intended to allow economical production and offer good configurational possibilities.

This object is achieved according to the invention by the subject matter mentioned in the independent claim. Particular embodiments of the invention are specified in the dependent claims.

The invention provides a lighting device, which comprises a carrier element having an elongate reception region which is U-shaped in cross section and comprises a first U-branch and a second U-branch, and a connecting branch connecting the two U-branches. The lighting device furthermore comprises an LED lighting module having at least one LED for generating light for light emission of the lighting device, the LED lighting module being arranged held on the carrier element. The lighting device furthermore comprises a contacting element for the electricity supply of the LED lighting module. The connecting branch comprises a through-opening, the contacting element and the LED lighting module being arranged electrically conductively and reversibly releasably connected to one another in such a way that this electrical connection passes through the through-opening.

By virtue of this configuration, the current-carrying wires of the electricity supply of the LED lighting module can be arranged on that side of the connecting branch which lies opposite the at least one LED of the lighting module. In this way, accessibility to the current-carrying wires is made more difficult and the lighting device is therefore particularly secure. Furthermore, particularly straightforward, secure and reliable replacement of the LED lighting module is made possible in this way.

Preferably, the lighting device is configured in such a way that the LED lighting module is held toollessly reversibly releasably on the carrier element. In this way, it is possible to achieve the effect that the LED lighting module particularly simply can be fastened on the carrier element, and can also be released therefrom, for example in order to be replaced by an alternative element or module. To this end, in particular, a magnetic holder and/or a latch connection and/or a spring holder may be provided.

Preferably, the electrical connection between the contacting element and the LED lighting module is a plug connection. In this way, the electrical connection can be produced particularly simply. In particular, to this end the contacting element comprises a printed circuit board with an integrated socket for the electrical connection to the LED lighting module. In this case, according to an advantageous refinement of the invention, the LED lighting module may be configured in such a way that it can be selectively arranged in different orientations, in particular in two orientations rotated through 180° on the carrier element, and can be coupled to the contacting element. To this end, in particular, the LED lighting module may comprise two plugs arranged rotated through 180° relative to one another, one of which—depending on the orientation of the LED lighting module—is then connected to the contacting element.

The printed circuit board furthermore comprises solder contacts or insulation piercing connection devices for internal wiring of the lighting device. In this way, the internal wiring can be arranged particularly protected in the reception region.

For particularly simple mounting of the contacting element on the carrier element, the contacting element advantageously comprises a spring or latch element, the lighting device being configured in such a way that the contacting element is arranged held by means of the spring or latch element on the reception region, in particular between the first U-branch and the second U-branch.

For particularly suitable dissipation of heat which is generated by the at least one LED of the LED lighting module during operation of the lighting device, the carrier element preferably comprises a planar contact surface and the LED lighting module comprises a planar surface region, the planar surface region being arranged thermally conductively contacting the planar contact surface.

For particularly suitable holding of the LED lighting module on the carrier element, the carrier element comprises, on an opposite side to the U-shaped reception region, a recess into which the LED lighting module is arranged inserted.

Preferably, the lighting device furthermore comprises at least one further LED lighting module and at least one further contacting element for the electricity supply of the at least one further LED lighting module, the connecting branch comprising at least one further through-opening, and the at least one further contacting element and the at least one further LED lighting module being arranged connected electrically conductively and reversibly releasably to one another in such a way that this at least one further electrical connection passes through the at least one further through-opening. In this way, the lighting device advantageously offers particularly good configurational possibilities. The plurality of LED lighting modules may, for example, be replaced in a versatile way with corresponding LED lighting modules of other types, which differ for example by their light emission properties from the LED lighting modules initially inserted.

Advantageously, the lighting device is configured in such a way that the at least one further LED lighting module is likewise arranged inserted into the recess. In this way, particularly simple assembly of the lighting device is possible.

Furthermore, the lighting device preferably also comprises an indirect lighting module for generating indirect illumination, the indirect lighting module being arranged inserted into the reception region. In this way, a particularly protected and at the same time compact arrangement of the indirect lighting module is made possible.

Furthermore, the lighting device preferably also comprises an operating device for the electricity supply of the LED lighting module, the operating device being arranged inserted into the reception region. In this way, a particularly protected and at the same time compact arrangement of the operating device is made possible.

Figure 1:
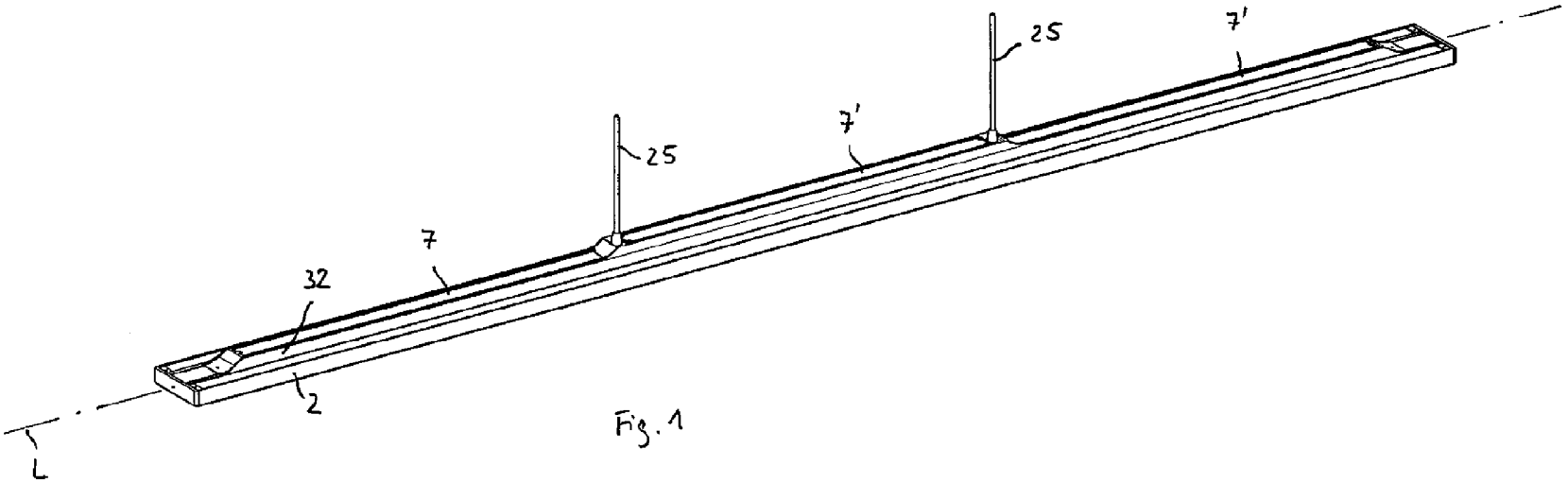
Figure 3:
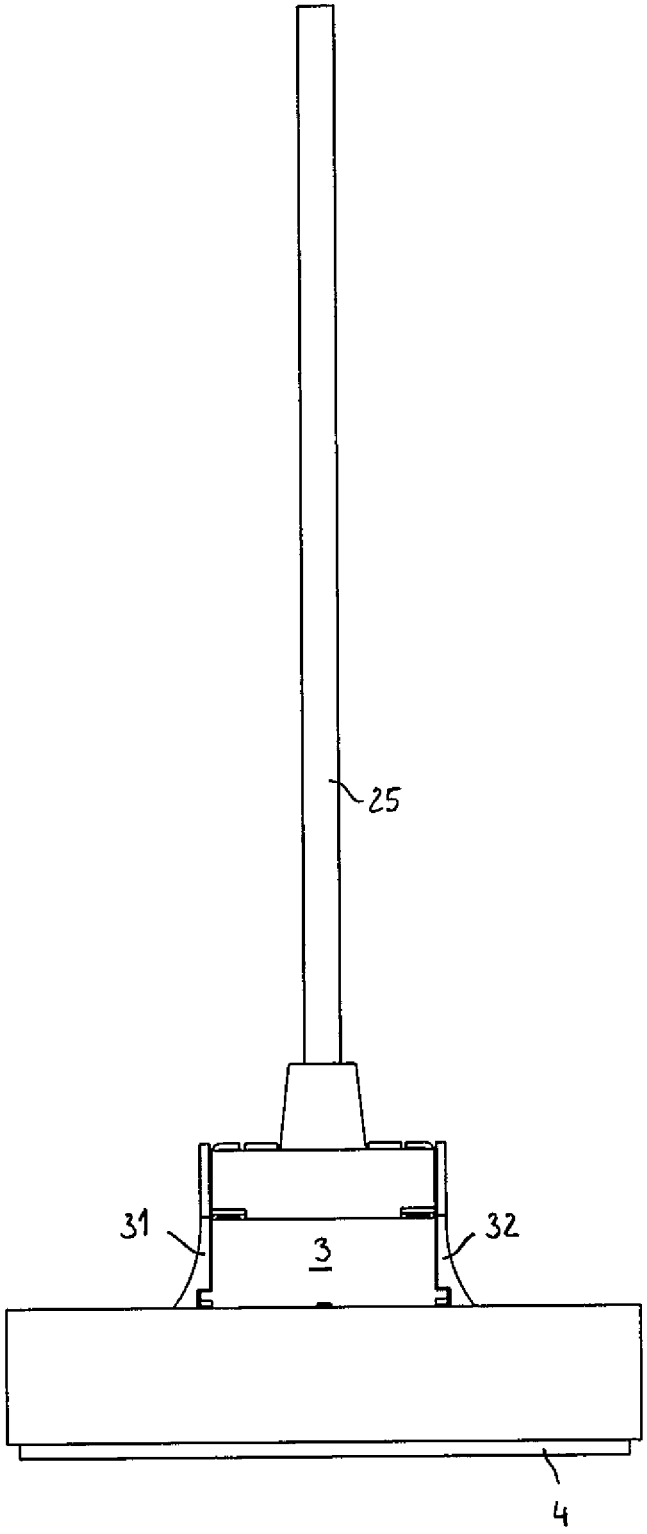
Figure 4:
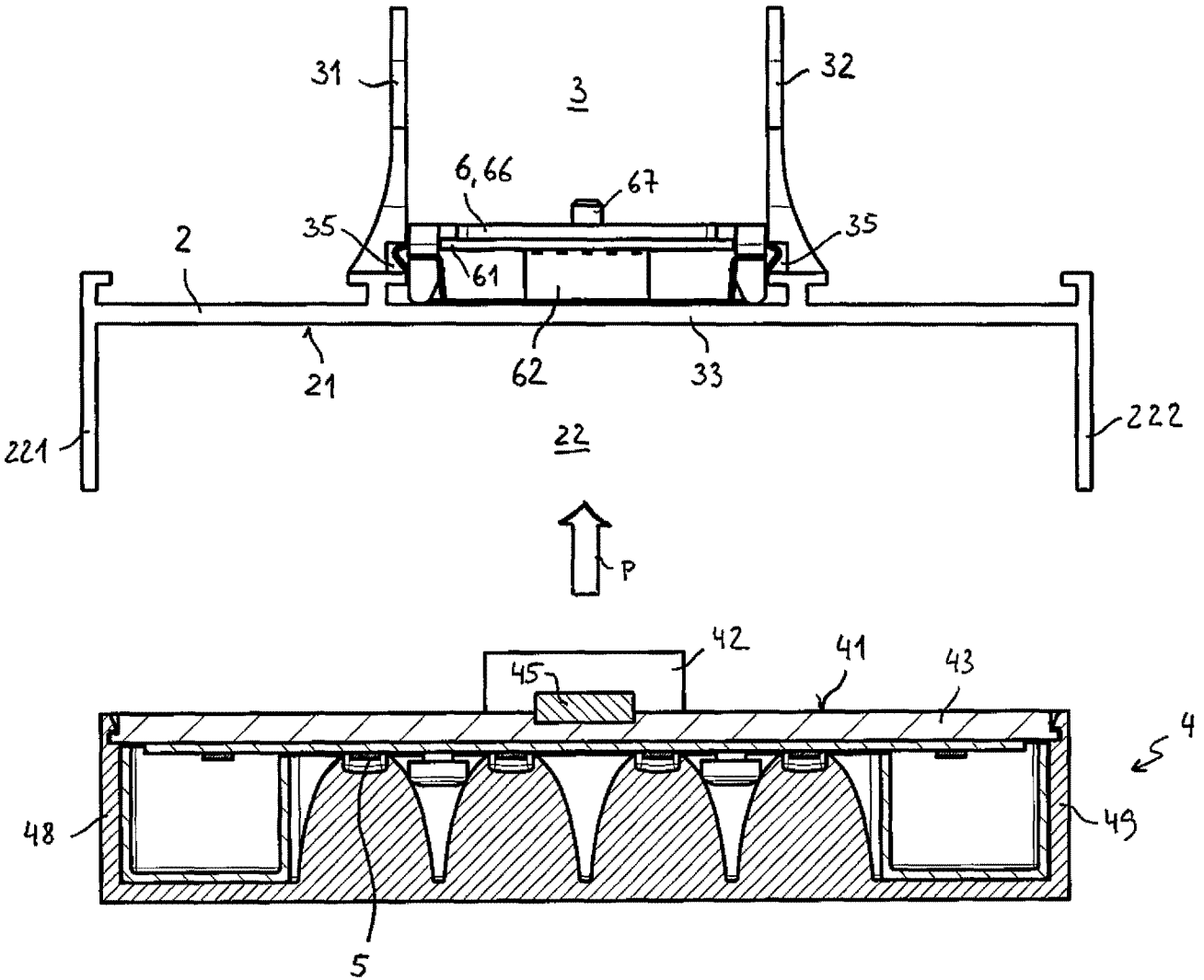
Figure 5:
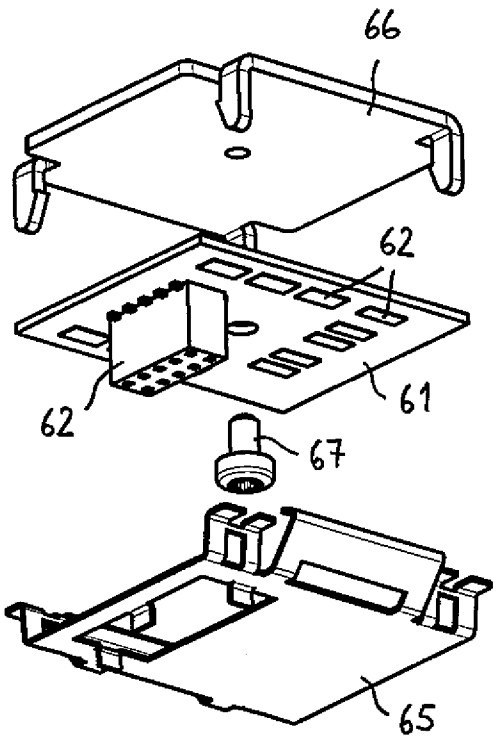
Figure 7:
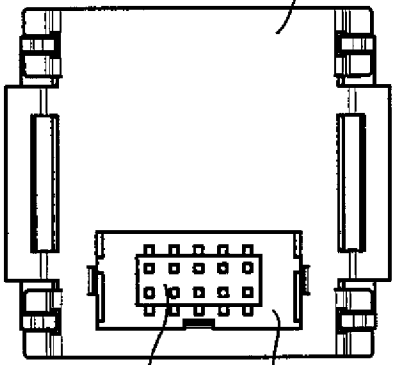
Figure 6:
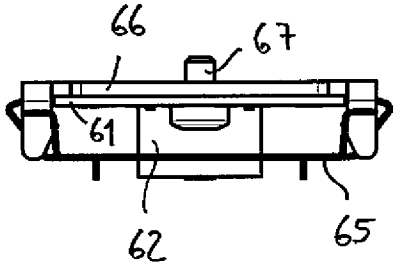
Figure 8:
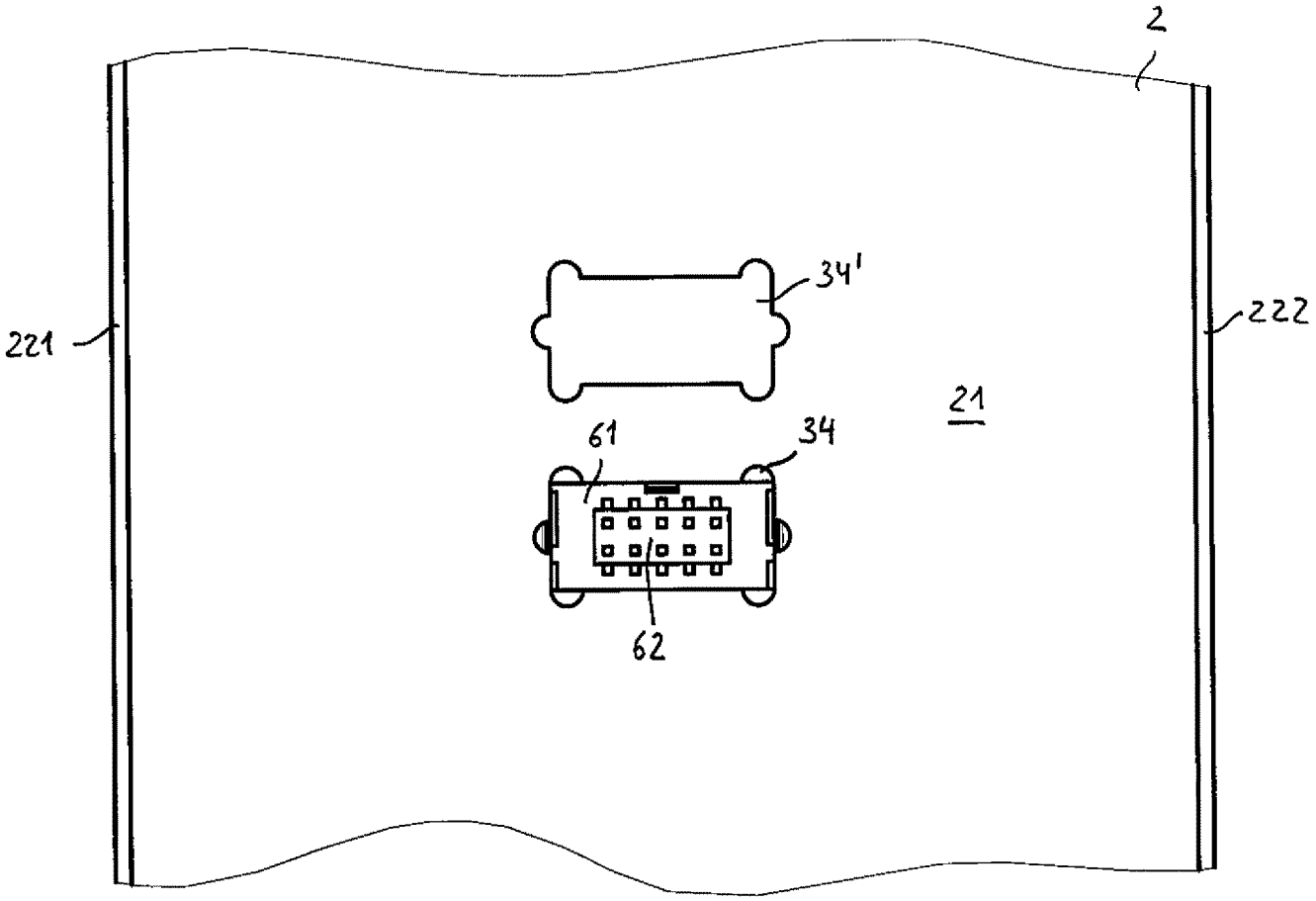
Figure 9:
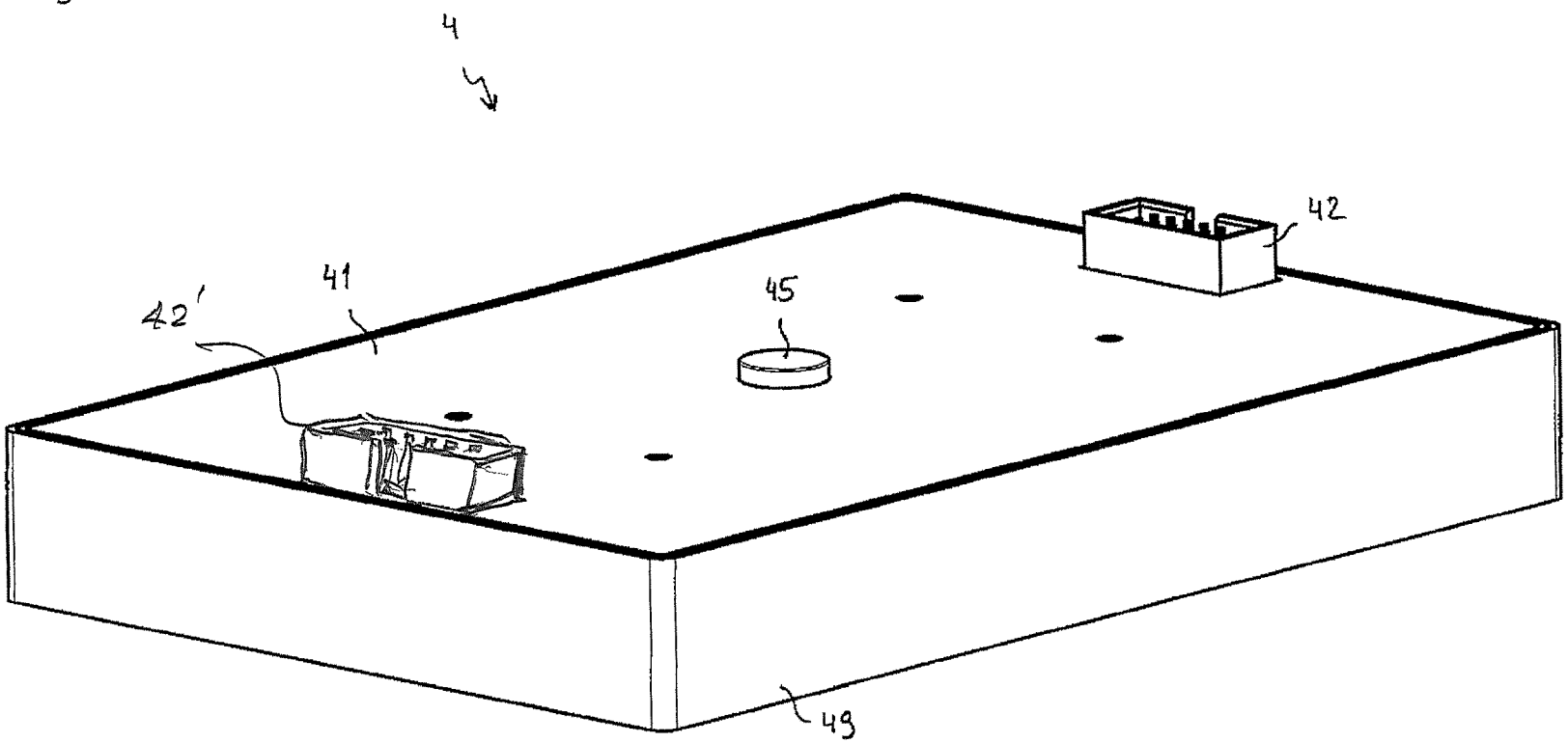
Figure 10:
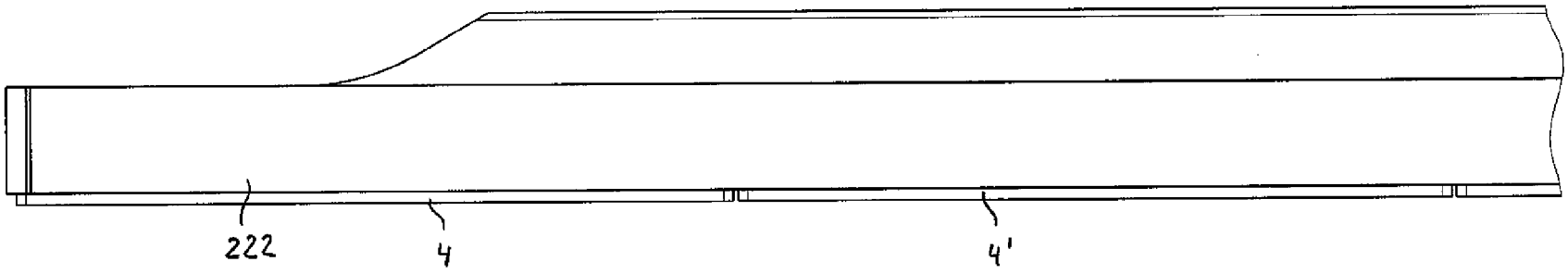
Figure 11:
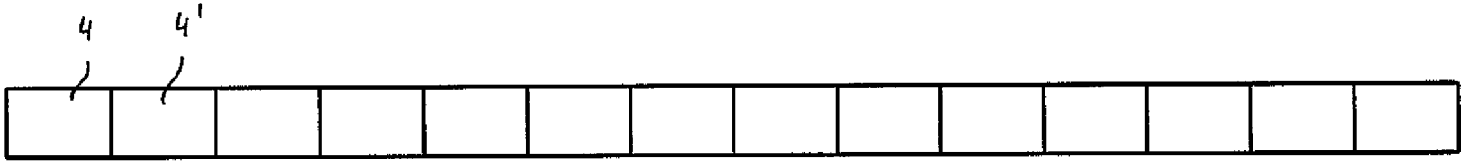

The invention will be explained in more detail below with the aid of an exemplary embodiment and with reference to the drawings, in which:

FIG. 1 shows a perspective diagram of a lighting device according to the invention in a view obliquely from above, FIG. 2 shows a side view of the lighting device, FIG. 3 shows a front view of the lighting device, FIG. 4 shows a cross-sectional diagram of the structure of the lighting device, FIG. 5 shows a diagram of the separated contacting element of the lighting device in the manner of an exploded representation, FIG. 6 shows a front view of the contacting element, FIG. 7 shows a view of the contacting element from below, FIG. 8 shows a view of a section of the carrier element of the lighting device from below, FIG. 9 shows a perspective view of the LED lighting module obliquely from above, FIG. 10 shows a side view of an end region of the lighting device, and FIG. 11 shows a schematic view of the lighting device from below.

FIG. 1 shows a perspective diagram of a view of a lighting device according to the invention obliquely from above. The lighting device may be provided in the form of a pendant lighting device. To this end, the lighting device may comprise at least one suspension element, for example in the form of at least one pendulum or at least one cord 25.

In the example shown, the lighting device is elongate overall so that it extends along a longitudinal axis L. FIG. 2 shows the lighting device in a side view and FIG. 3 shows it in an end-on view, or front view, i.e. with a viewing direction parallel to the longitudinal axis L.

The lighting device has a carrier element 2, which comprises an elongate reception region 3 which is U-shaped in cross section. Preferably, the entire carrier element 2 is elongate and extends parallel to the longitudinal axis L. The carrier element 2 is preferably formed as a base housing of the lighting device FIG. 4 outlines a cross section normal to the longitudinal axis L. Because of its U-shape, the reception region 3 comprises a first U-branch 31, a second U-branch 32 and a connecting branch 33 connecting the two U-branches 31, 32. In the example shown, the reception region 3—in the orientation of the lighting device ready for operation—is oriented so as to be open upward; the two U-branches 31, 32 thus correspondingly extend upward.

It is advantageous in terms of production technology for the carrier element 2 to be configured in the manner of a profiled section.

Furthermore, the lighting device comprises an LED lighting module 4. In FIG. 4, the LED lighting module 4 is shown separated, or removed, from the carrier element 2. Starting from the situation outlined in FIG. 4, in order to be connected to the carrier element 2 the LED lighting module 4 may, as indicated by a thick arrow P, be moved from below upward against the carrier element 2. In the state of the lighting device ready for operation, the LED lighting module 4 is thus arranged on a lower side of the carrier element 2.

FIG. 9 shows a perspective view obliquely from above of the LED lighting module—separated from the carrier element 2.

As indicated by way of example in the sectional representation of FIG. 4, the LED lighting module 4 comprises at least one LED 5 for generating light for light emission of the lighting device. In the state ready for operation, the LED lighting module 4 is arranged held on the carrier element 2. In the example shown, the LED lighting module 4 is used for generating direct illumination directed downward.

For the electricity supply of the LED lighting module 4, the lighting device furthermore comprises a contacting element 6.

FIG. 8 outlines a view from below of the carrier element 2, i.e. with the LED lighting module 4 removed. The viewing direction corresponds to the arrow P sketched in FIG. 4. The connecting branch 33 of the reception region 3 comprises a through-opening 34. The contacting element 6 and the LED lighting module 4 are—in the state of the lighting device ready for operation—arranged electrically conductively connected to one another in such a way that this electrical connection passes through the through-opening 34.

The contacting element 6 and the electrical connection are preferably also configured in order to transmit control signals to the LED lighting module 4.

The lighting device is furthermore configured in such a way that the LED lighting module 4 is reversibly releasably connected to the contacting element 6.

Preferably, the electrical connection between the contacting element 6 and the LED lighting module 4 is configured as a reversibly releasable plug connection. Advantageously, to this end the contacting element 6 comprises a socket 62 for this electrical connection to the LED lighting module 4. The socket 62 may in this case be arranged in such a way that it projects into the through-opening 34 or passes through the latter. The LED lighting module 4 in this case correspondingly comprises a plug 42 for the electrical connection, which—in the state ready for operation—is inserted into the socket 62.

Preferably, the lighting device is furthermore configured in such a way that the LED lighting module 4 is held toollessly reversibly releasably on the carrier element 2. In this way, particularly simple handling when assembling the lighting device, and optionally when replacing the LED lighting module 4, is made possible. This holder may, for example, be provided configured in the form of a magnetic holder and/or a spring holder or by means of a latch connection. In the example shown, the LED lighting module 4 to this end comprises a magnet 45 on an upper side.

The LED lighting module 4 can thus be removed from the carrier element 2, and reconnected to the latter, in a way which is very convenient in terms of handling. The LED lighting module 4 in this regard constitutes a "lighting component" of the lighting device.

FIG. 5 shows a diagram of the separated contacting element 6 in the manner of an exploded representation. FIG. 6 shows a view of the separated contacting element 6 along the longitudinal axis L, and FIG. 7 shows a corresponding view from below.

The contacting element 6 may in particular comprise a printed circuit board 61, the socket 62 preferably being arranged on the printed circuit board 61, i.e. so to speak being integrated into the printed circuit board 61.

Furthermore, the contacting element 6 preferably comprises a spring or latch element 65, the lighting device being configured in such a way that the contacting element 6 is arranged held, in particular held in a latching fashion, by means of the spring or latch element 65 on the reception region 3, in particular between the first U-branch 31 and the second U-branch 32. In this way, the assembly of the lighting device is facilitated. As outlined by way of example in FIG. 4, to this end the two U-branches 31, 32 preferably respectively comprise a groove 35 which is open toward the center of the reception region 3, and into which the spring or latch element 65 is arranged latched so as to hold the contacting element 6 fixed in position relative to the carrier element 2. The contacting element 6 can in this way be placed and fixed accurately in position in the reception region 3.

In the example shown, the contacting element 6 furthermore also comprises a holding element 66, particularly in the form of a holding plate, on which the printed circuit board 61 is arranged fixed, preferably by means of a connecting element, for example a screw 67. The spring or latch element 65 may be arranged on the holding element 66 with a snap-fit or by means of a latch connection.

By virtue of the described arrangement, mechanical encoding can furthermore be achieved, so that incorrect insertion of the LED lighting module 4 can be reliably prevented.

Overall, the contacting element 6 in combination with the carrier element 2 allows prefabricatable, rapid and toolless mounting of the contacting element 6 on the carrier element 2.

The carrier element 2 preferably consists of a metal, in particular a highly thermally conductive metal, for example aluminum. For particularly suitable dissipation of heat which is generated by the at least one LED 5 during operation of the lighting device, the carrier element 2 comprises a planar contact surface 21, in particular facing downward, and the LED lighting module 4 comprises a planar surface region 41, in particular facing upward, the planar surface region 41 being arranged thermally conductively contacting the planar contact surface 21. In particular, the LED lighting module 4 may comprise an outer wall 43 facing upward, by which the surface region 41 is formed, the outer wall 43 consisting of a highly thermally conductive metal, for example aluminum.

In the example shown, the magnet 45 of the LED lighting module 4 is arranged on the outer wall 43 in such a way that it protrudes upward beyond the surface region 41. Preferably, at the correspondingly matching position of the carrier element 2, a corresponding recess (not shown in the figures) is provided, in which the magnet 45 engages in such a way that the planar surface region 41 of the outer wall 43 can contact the planar contact surface 21 of the carrier element 2 in a planar fashion.

The carrier element 2 furthermore preferably comprises, on a side opposite the U-shaped reception region 3,—as shown by FIG. 4—a recess 22 into which the LED lighting module 4 is arranged inserted. In the example shown, the recess 22 is accordingly open downward. The planar contact surface 21 is in this case formed by the bottom of this recess 22. In this way, a positionally fixed arrangement of the LED lighting module 4 can be achieved particularly suitably. The assembly of the lighting device is facilitated by this.

As is the case in the example shown, the carrier element 2 is preferably configured as a profiled section, comprising a horizontal main branch by which both the connecting branch 33 and the bottom of the recess 22 are formed. In this way, particularly suitable removal of heat is made possible. In this case, the recess 22 is advantageously wider than the reception region 3, for example at least two times as wide, outer sides of the lighting device being formed by the carrier element 2 on both sides of the reception region 3, so that in this way particularly effective removal of heat in an outer region of the lighting device is made possible.

Preferably, the recess 22 extends over the entire length of the lighting device. In order to close the recess 22, end caps may in this case be provided at the two long-side end regions of the lighting device.

As shown by way of example by FIG. 1, the reception region 3 may extend approximately over the entire length of the lighting device, for example over at least 80% of the length of the lighting device.

In the example shown, the recess 22 is configured elongately, in particular parallel to the longitudinal axis L, having two lateral bounding walls 221, 222 which likewise extend parallel to the longitudinal axis L, preferably vertically downward. The LED lighting module 4 in this case advantageously comprises two side walls 48, 49, the configuration being such that the bounding walls 221, 222 of the recess 22 are configured in particular as guide surfaces for guiding the side walls 48, 49 of the LED lighting module 4 when the LED lighting module 4 is being fastened on the carrier element 2. In this way, positional securing of the LED lighting module 4 can particularly suitably be achieved in a direction transverse to the longitudinal axis L. The LED lighting module 4 may for example overall have an approximately cuboid shape, the outer wall 43 forming the upper cover surface of the cuboid and the two side walls 48, 49 forming two side walls of the cuboid.

FIG. 10 outlines a side view of an end region of the lighting device, and FIG. 11 outlines a view of the lighting device from below. As indicated by way of example in these figures, in the example shown the lighting device also comprises a further LED lighting module 4'. Furthermore, the lighting device comprises a further contacting element for the electricity supply of the further LED lighting module 4', the connecting branch 33 comprising at least one further through-opening 34', and the further contacting element and the further LED lighting module 4' being arranged electrically conductively and reversibly releasably connected to one another in such a way that this one further electrical connection passes through the further through-opening 34'. In other words, the electrical connection between the further LED lighting module 4' and the further contacting element is configured in a similar way to the electrical connection mentioned first.

To this end, the further LED lighting module 4' is advantageously arranged, in relation to the longitudinal axis L, next to the LED lighting module 4 mentioned first.

In particular, the lighting device may comprise in total more than two correspondingly configured LED lighting modules, which are arranged forming a line along the longitudinal axis L, as outlined in FIG. 11 by way of example for the case of fourteen LED lighting modules. In this case, the configuration is such that each of the LED lighting modules is supplied with electricity by means of a respectively associated and similarly configured contacting element, and a separate through-opening in the connecting branch 33 is respectively formed for the electrical connections between the LED lighting modules and the respectively associated contacting elements. To this end, the through-openings may advantageously be formed in the connecting branch 33 with a respectively identical distance from one another.

Particularly simple assembly of the lighting device, or particularly simple insertion of the LED lighting modules, is in this case made possible when the lighting device is configured in such a way that the at least one further LED lighting module 4' is likewise arranged inserted into the recess 22. Correspondingly, the LED lighting modules of the lighting device are advantageously all configured with the same shape.

The lighting device may furthermore advantageously comprise an element with a different function instead of an LED lighting module, for example a dummy piece or a sensor element, etc.

Furthermore, according to an advantageous refinement of the invention, at least some of the LED lighting modules 4, 4' may selectively be arranged in different orientations, in particular in two orientations rotated through 180° on the carrier element 2. This is expedient in particular when the optical elements, i.e. for example the lenses of the LED lighting module 4, are configured in such a way that they lead to asymmetric light emission. In this case, specifically, the LED lighting modules 4 respectively located at the end regions of the carrier element 2 should respectively be arranged in different orientations in order, as seen overall, again to achieve symmetrical light emission for the lighting device.

The selective arrangement of an LED lighting module 4 may be made in a straightforward way by the lighting module 4 comprising two plugs 42, preferably respectively arranged rotated through 180° with respect to one another. In the case of the LED lighting module 4 represented in FIG. 9, on the side lying opposite the plug 42 represented there is a further plug 42' so that, depending on the orientation of the LED lighting module 4, one of the two plugs is coupled to the socket 62 and ensures the electricity supply for the LEDs. The second—unused—plug, conversely, then preferably projects into a corresponding opening in the carrier element 2, but is otherwise inactive.

In the case of a plurality of LED lighting modules, the lighting device preferably comprises internal wiring for the electricity supply of the LED lighting modules as well as for the transmission of control signals to the LED lighting modules, particularly in the form of a cable harness, which is arranged extending through the reception region 3. In this way, the internal wiring can be arranged particularly protected. Furthermore, in this way it is possible to achieve the effect that the internal wiring cannot be seen with typical observation of the lighting device, and in particular not with the LED lighting module removed. In this case, only a view of the contacting element 6 is enabled, as indicated in FIG. 8.

For an advantageous electrical connection between the internal wiring and the contacting element 6, the latter preferably comprises solder contacts 62 or insulation piercing connection devices, or the like. These are preferably formed on the printed circuit board 6.

As indicated in FIG. 1, the reception region 3 may also advantageously be used to receive an indirect lighting module 7 for generating indirect illumination. To this end, the indirect lighting module may be arranged inserted into the reception region 3, for example clamped. The indirect lighting module 7 may to this end advantageously comprise an elongate U-shaped base body which is open upward and is correspondingly arranged held, or held by clamping, between the two U-branches 31, 32 of the reception region 3. At least one clamp or the like may also be provided in order to hold the indirect lighting module 7.

As a light source, the indirect lighting module 7 may comprise at least one LED, for example an LED strip, which is advantageously arranged in the base body. For protection against dust, etc., the indirect lighting module 7 furthermore preferably comprises an optically transmissive cover, which covers the U-shaped base body from above.

Naturally, the lighting device may furthermore comprise at least one further indirect lighting module 7', preferably configured in a similar way thereto, as indicated by way of example in FIG. 1.

Preferably, the LED lighting module 4, or the LED lighting modules, may be configured in order to generate both a directional light component and a diffuse light component, in which case these two components of each individual LED lighting module may be driven separately. Thus, different lighting atmospheres and scenes can be generated by a user of the lighting device according to the lighting requirement.

An operating device for the electricity supply of the LED lighting module 4, or of the LED lighting modules, and optionally of the at least one indirect lighting module, may be advantageously arranged inserted into the reception region 3.

The at least one suspension element, i.e. for example the at least one cord, 25 may also be fastened—for example by means of at least one clamp—on the reception region 3 or on the two U-branches 31, 32.

In the exemplary embodiment described above, the lighting device is elongate and to this extent constitutes a long-field lighting device. The lighting device according to the invention is not, however, restricted to this geometrical configuration. Provision may, for example, also be made for the carrier element or the base housing to have a rectangular or square or round base shape instead of an elongate shape.

Furthermore, the lighting device described above is a pendant lighting device. This as well is not, however, restrictive. The lighting device may, for example, also be configured as a recessed ceiling lighting device, as an attached lighting device, as a downlight, as a wall lighting device, as a standard lighting device, etc.

The basis of the LED lighting module offers the possibility of versatile variation of the basic structure of the lighting device as a function of the module size of the LED lighting module.

The invention claimed is:

1. A lighting device, comprising:

a carrier element having an elongate reception region which is U-shaped in cross section, so that the reception region comprises a first U-branch and a second U-branch, and a connecting branch connecting the two U-branches, a plurality of LED lighting modules each having at least one LED for generating light for light emission of the lighting device, the LED lighting modules being detachably arranged held on the carrier element, and a plurality of contacting elements for an electricity supply of the LED lighting modules, wherein the connecting branch comprises a plurality of through-openings and the contacting elements each comprising a socket for the electrical connection associated with the carrier element and at least one mating plug on each of the LED lighting modules comprises at least one mating plug arranged electrically conductively and reversibly releasably connectable to one of the sockets in such a way that this electrical connection passes through one of the through-openings.

2. The lighting device as claimed in claim 1, which is configured in such a way that the LED lighting modules are held toollessly reversibly releasably on the carrier element, by a magnetic holder and/or by a latch connection and/or a spring holder.

3. The lighting device as claimed in claim 1, wherein the LED lighting module can be selectively arranged in two different orientations rotated through 180° on the carrier element.

4. The lighting device as claimed in claim 3, wherein the LED lighting module comprises two plugs arranged rotated through 180° relative to one another.

5. The lighting device as claimed in claim 1, wherein the contacting element comprises a printed circuit board with an integrated socket for the electrical connection to the LED lighting module.

6. The lighting device as claimed in claim 5, wherein the printed circuit board furthermore comprises solder contacts or insulation piercing connection devices for internal wiring of the lighting device.

7. The lighting device as claimed in claim 1, wherein the contacting element comprises a spring or latch element, the lighting device being configured in such a way that the contacting element is arranged held by means of the spring or latch element on the reception region, in particular between the first U-branch and the second U-branch.

8. The lighting device as claimed in claim 1, wherein the carrier element comprises a planar contact surface and the LED lighting module comprises a planar surface region, the planar surface region being arranged thermally conductively contacting the planar contact surface.

9. The lighting device as claimed in claim 1, wherein the carrier element comprises, on an opposite side to the U-shaped reception region, a recess into which the LED lighting module is arranged inserted.

10. The lighting device as claimed in claim 9, configured in such a way that the at least one further LED lighting module is likewise arranged inserted into the recess.

11. The lighting device as claimed in claim 1, furthermore comprising an indirect lighting module for generating indirect illumination, the indirect lighting module being arranged inserted into the reception region.

12. The lighting device as claimed in claim 1, furthermore comprising an operating device for the electricity supply of the LED lighting module, the operating device being arranged inserted into the reception region.

13. A lighting device, comprising:

a carrier element having an elongate reception region which is U-shaped in cross section, so that the reception region comprises a first U-branch and a second U-branch, and a connecting branch connecting the two U-branches, a plurality of LED lighting modules each having at least one LED for generating light for light emission of the lighting device, the LED lighting modules being detachably arranged held on the carrier element, and a plurality of contacting elements for an electricity supply of the LED lighting modules, wherein the connecting branch comprises a plurality of through-openings and the contacting elements each comprising a socket for the electrical connection associated with the carrier element and at least one mating plug on each of the LED lighting modules comprises at least one mating plug arranged electrically conductively and reversibly releasably connectable to one of the sockets in such a way that this electrical connection passes through one of the through-openings, wherein the LED lighting module can be selectively arranged in two different orientations rotated through 180° on the carrier element;

wherein the LED lighting module comprises two plugs arranged rotated through 180° relative to one another depending on the orientation of the LED lighting module (4) one of the two plugs is coupled to the socket and ensures the electricity supply, wherein the second plug in inactive.

* * * * *